US007030774B2

(12) United States Patent
Krenz et al.

(10) Patent No.: US 7,030,774 B2
(45) Date of Patent: Apr. 18, 2006

(54) FLOATING VISIBLE INDICATOR FOR AN INSTRUMENT CLUSTER

(75) Inventors: Andrew R Krenz, Berkley, MI (US); David Bolognino, Oxford, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/273,202

(22) Filed: Oct. 17, 2002

(65) Prior Publication Data

US 2003/0107497 A1 Jun. 12, 2003

Related U.S. Application Data

(60) Provisional application No. 60/340,985, filed on Dec. 7, 2001.

(51) Int. Cl.
*G08B 5/36* (2006.01)

(52) U.S. Cl. ..... 340/815.47; 340/815.45; 340/815.54; 340/815.57; 340/815.73; 340/525; 345/4; 345/7; 345/45; 313/505; 362/23

(58) Field of Classification Search ..... 340/815.47, 340/815.45, 332, 438, 525, 691.1, 815.42; 345/4, 5, 76, 7, 9, 45, 36; 40/544; 313/12, 313/505, 509; 362/26, 30, 23, 489; 305/815.54, 305/815.57, 815.73, 815.66
See application file for complete search history.

(56) References Cited

U.S. PATENT DOCUMENTS

| | | | | |
|---|---|---|---|---|
| 5,332,946 | A * | 7/1994 | Eckersley et al. | 313/506 |
| 5,557,295 | A * | 9/1996 | Miyashita et al. | 345/36 |
| 5,702,171 | A * | 12/1997 | Lenzi | 362/29 |
| 6,115,008 | A * | 9/2000 | Palalau et al. | 345/7 |
| 6,181,301 | B1 * | 1/2001 | Inoguchi et al. | 345/5 |

* cited by examiner

*Primary Examiner*—Davetta W. Goins
(74) *Attorney, Agent, or Firm*—Laura C. Hargitt

(57) ABSTRACT

A visible indicator for an instrument cluster is backlit with an electroluminescent (EL) film. A mounting plate is located a first distance from a light source and includes a first aperture. A translucent lens is located adjacent to the mounting plate. An EL film is located adjacent to the translucent lens and includes a second aperture having a laser-cut first shape. A lens is located a second distance from the EL film and includes a sandblasted inner surface facing the EL film.

23 Claims, 2 Drawing Sheets

FLOATING VISIBLE INDICATOR FOR AN INSTRUMENT CLUSTER

CROSS-REFERENCE TO RELATION APPLICATION

This application claims the benefit of U.S. Provisional Application No. 60/340,985, filed Dec. 7, 2001, which is hereby incorporated by reference.

TECHNICAL FIELD

The present invention relates to visual indicators for instrument clusters, and more particularly to visual indicators for instrument clusters that are backlit with electroluminescent film.

BACKGROUND OF THE INVENTION

Visible indicators, often called tell-tale lights, are common on instrument clusters found in vehicles. Examples include fog lamp indicators, bright headlight indicators, and engine malfunction warning indicators. The visual indicators notify the operator of operational problems and/or the operational status of vehicle systems.

A hole is typically cut or stamped in the instrument cluster in a shape of the desired indicator. A colored lens is placed over the hole. When active, a light bulb behind the instrument cluster shines through the colored lens. Conventional visible indicators tend to be aesthetically displeasing because they leave a visible stenciled dark spot that can be seen on the instrument cluster in daylight when the visible indicator is inactive.

Currently, instrument clusters backlit with electroluminescent (EL) film are being used. These instrument clusters use a sheet that is cut to the shape of the visible indicator. Alternately, a silk-screened blackout is placed over the EL film. These approaches also leave a visible dark spot in daylight when the visible indicator is inactive. These approaches also prevent the EL film and visible indicator from being two different colors.

Liquid Crystal Display (LCD) screens can also be used. The LCD screens are located in the EL sheet mounting layer and are driven by a computer. The 256 color palette of the LCD does usually not create a color that matches the inherent luminescent property of the EL film. When the LCD is switched off, a large dark square can be seen. LCD screen types have similar aspect ratios, which prevents some forms of visible indicator location and design. Some LCD screens also include components that are not yet approved for automotive purposes.

In another approach, a hole is made in the EL film. A backlight generates the visible indicator. Usually, the hole is stamped or cut. These methods are not desirable because the EL film is composed of several laminated layers. If disturbed, the layers will open the layered circuit locally and create a dark spot around the visible indicator. Also, shear stress during cutting can cause delamination, particularly at right angle turns in the cutter path. The driver can see the stenciled hole in the EL film in daylight when the visible indicator is inactive.

SUMMARY OF THE INVENTION

A visible indicator according to the present invention for an instrument cluster is backlit with an electroluminescent (EL) film. A mounting plate is located adjacent to a light source and includes a first aperture. A translucent lens is located adjacent to the mounting plate. An EL film is located adjacent to the translucent lens and includes a second aperture having a first shape. A lens is located a second distance from the EL film and includes an inner surface facing the EL film that is sandblasted.

In other features of the invention, the light source is located in a housing. The housing includes a non-reflective inner surface to prevent secondary reflections from the light source. The light source is an incandescent light bulb with a filament. The incandescent light bulb is mounted with the filament aligned with a plane through a line of sight of an observer to prevent double images.

In still other features of the invention, the translucent lens is tinted a color related to a desired color for the visible indicator. The second aperture in the EL film is laser cut. The first shape that is projected on the lens appears to float behind the lens and in front of the EL film when the light source is on.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DESCRIPTION OF THE PREFERRED EMBODIMENT

The following description of the preferred embodiment(s) is merely exemplary in nature and is in no way intended to limit the invention, its application, or uses.

Figure 1:
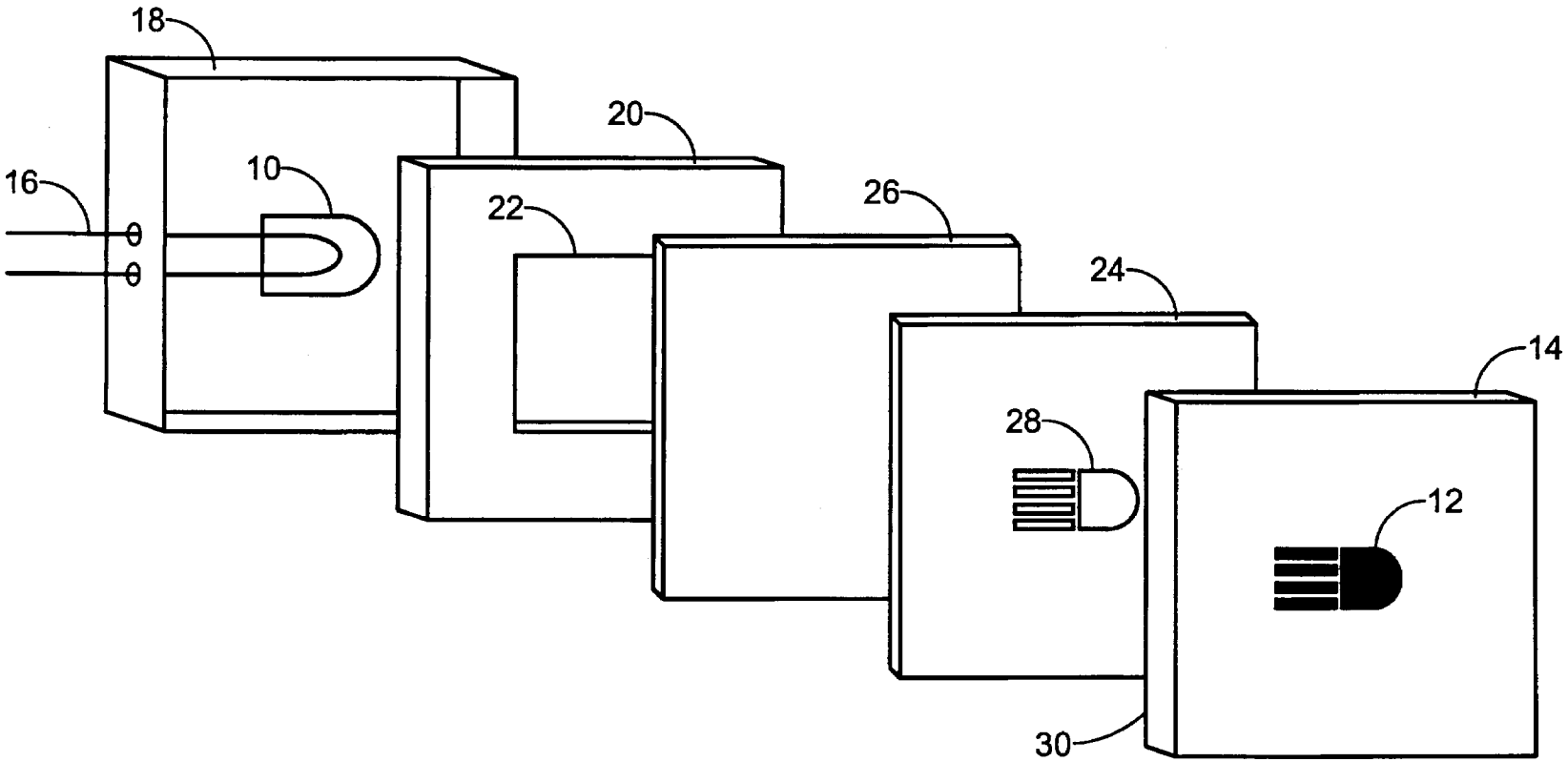
FIG. 1 is an exploded perspective view of the visible indicator for an instrument cluster that is backlit with EL film.
Figure 2:
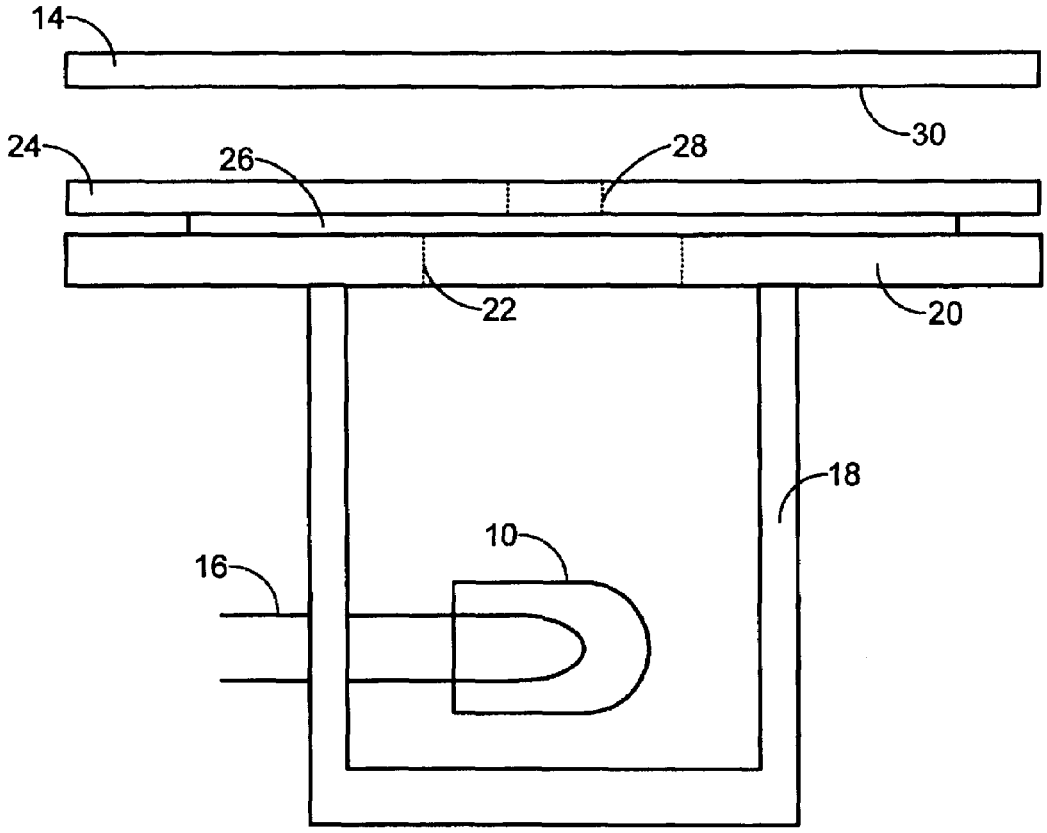
FIG. 2 is a cross-sectional view of the visible indicator of the present invention.

Referring now to FIGS. 1 and 2, a light source 10 displays a visible indicator 12 on a lens 14 when the light source 10 is illuminated. For example, the visible indicator 12 in FIG. 1 is a symbol indicating activation of highbeam headlights. Skilled artisans can appreciate that the visible indicator 12 can also indicate the operation of other vehicle systems and devices such as the activation of fog lamps, an engine warning light or any other system or message. Wires 16 are connected by a switch (not shown) to a power source such as a vehicle battery. In the case of the highbeam headlights, the switch is typically a highbeam switch that is floor mounted, turn signal mounted, dashboard mounted, etc. The light source 10 can also be activated by a vehicle data bus or other vehicle systems.

Typically, a vehicle instrument cluster includes several visible indicators, each with its own light source 10. The light sources 10 are separated so that the visible indicators 12 can appear individually in their respective locations. Light sources 10 are usually housed separately so that one light source 10 does not illuminate another visible indicator 12.

In a preferred embodiment, the light source 10 is located in a housing 18. An inner surface of the housing 18 is counted with a non-reflective material to prevent secondary reflections from the light source 10. Alternately, the housing 18 is made of a non-reflective material. In a preferred embodiment, the light source 10 is an incandescent light bulb with a filament. The incandescent light bulb is preferably mounted with its filament aligned with a plane through a line of sight of a driver to prevent double images on the lens 14.

A mounting plate 20 is located a first distance from the light source 10. Light from the light source shines through an aperture 22 in the mounting plate 20. The mounting plate 20 is preferably located on top of the housing 18. The mounting plate 20 may extend to other housings for other visible indicators and/or to other areas of the instrument cluster.

A translucent lens 26 is connected to the mounting plate 20. The translucent lens 26 covers the aperture 22 of the mounting plate 20. The translucent lens 26 has a color such as blue that determines the color of the visible indicator 12 on the lens 14. The translucent lens 26 has minimum dimensions that are sufficient to cover the aperture 22 of the mounting plate 20. Other visible indicators on the instrument cluster may have translucent lenses with different colors.

An EL film 24 is connected to the translucent lens 26 and has a second aperture 28 formed therein. The second aperture 28 in the EL film 24 has a shape of the desired visible indicator 12. The second aperture 28 preferably has dimensions that are smaller than the aperture 22. Since the translucent lens 26 is relatively thin, the EL film 24 may also be attached to the translucent lens 26 and the mounting plate 20. Like the mounting plate 20, the EL film 24 may extend beyond the housing 18 to other areas of the instrument cluster. The EL film 24 illuminates the instrument cluster when power is applied to the EL film 24. The EL film 24 may be powered by the vehicle battery and may be activated by an ignition switch, a headlight switch, the vehicle data bus, or any other suitable switch. The second aperture 28 is preferably laser cut in the EL film 24 to eliminate shear stress that would otherwise occur if the second aperture was stamped or cut.

The lens 14 is located a second distance from the EL film 24. The lens 14 includes an inner surface that is sandblasted. The sandblasted inner surface 30 is positioned adjacent to an outer surface of the EL film 24. The sandblasted inner surface 30 hides the laser-cut second aperture 28. The visible indicator 12 is projected onto the sandblasted surface 30 of the lens 14 when the light source 10 is on. When the visible indicator 12 is projected onto the sandblasted surface 30, the visible indicator 12 appears to float behind the lens 14 and in front of the EL film 24.

The lens 14 is preferably tinted. The tinting of the lens 14 tunes the EL film 24 to a desired color when the EL film 24 is illuminated. The tinting also provides a desired color of the instrument cluster when the EL film 24 is not illuminated. The lens 14 may also extend beyond the visible indicator 12 to cover the entire area backlit by EL film 24 as well as other areas of the instrument cluster. In a preferred embodiment, the lens 14 is made of polypropylene.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and the following claims.

The invention claimed is:

1. A visible indicator for an instrument cluster that is backlit with an electroluminescent (EL) film, comprising:
- a light source;
- a mounting plate located adjacent to said light source and including a first aperture;
- a translucent lens located adjacent to said mounting plate;
- an EL film located adjacent to said translucent lens with a second aperture having a first shape; and
- a lens that is located a second distance from said EL film and includes an inner surface facing said EL film that is sandblasted.

2. The visible indicator of claim 1 wherein said light source is located in a housing.

3. The visible indicator of claim 2 wherein said housing includes a non-reflective inner surface material to prevent secondary reflections from said light source.

4. The visible indicator of claim 1 wherein said light source is an incandescent light bulb with a filament.

5. The visible indicator of claim 4 wherein said incandescent light bulb is mounted with said filament aligned with a plane through a line of sight of an observer to prevent double images.

6. The visible indicator of claim 1 wherein a first distance between said EL film and said light source is related to a desired size of said first shape that is projected on said lens when said light source is on.

7. The visible indicator of claim 1 wherein said translucent lens is tinted a color related to a desired color for said visible indicator.

8. The visible indicator of claim 1 wherein said second aperture in said EL film is laser cut.

9. The visible indicator of claim 1 wherein said inner surface of said lens hides said second aperture formed in said EL film.

10. The visible indicator of claim 1 wherein said first shape that is projected on said lens appears to float behind said lens and in front of said EL film when said light source is on.

11. The visible indicator of claim 1 wherein said lens is tinted to tune said EL film to a first desired color when said EL film is illuminated and provides a second desired color of said instrument cluster when said EL film is not illuminated.

12. The visible indicator of claim 1 wherein said lens is made of polypropylene.

13. A method for displaying a visible indicator on an instrument cluster that is backlit with an electroluminescent (EL) film, comprising:
- forming a first aperture in a mounting plate;
- locating said mounting plate adjacent to a light source;
- positioning a translucent lens adjacent to said mounting plate;
- positioning an EL film adjacent to said translucent lens;
- forming a second aperture having a first shape in said EL film;
- sandblasting an inner surface of a lens; and
- positioning said lens a second distance from said EL film with said inner surface facing said EL film.

14. The method of claim 13 further comprising locating said light source in a housing.

15. The method of claim 14 further comprising providing a non-reflective inner surface on said housing to prevent secondary reflections from said light source.

16. The method of claim 13 wherein said light source is an incandescent light bulb with a filament.

17. The method of claim 16 further comprising mounting said incandescent light bulb with said filament aligned with a plane through a line of sight of an observer to prevent double images.

18. The method of claim 13 wherein said translucent lens is tinted a color related to a desired color for said visible indicator.

19. The method of claim 13 further comprising laser cutting said second aperture in said EL film.

20. The method of claim 13 wherein said first shape projected on said lens appears to float behind said lens and in front of said EL film when said light source is on.

21. The method of claim 13 whether said lens is tinted to tune said EL film to a first desired color when said EL film is illuminated and provides a second desired color of said instrument cluster when said EL film is non-illuminated.

22. The method of claim 13 wherein said lens is made of polypropylene.

23. A visible indicator for an instrument cluster backlit with electroluminescent (EL) film comprising:

a housing having a non-reflective inner surface;

an incandescent light bulb with a filament located in said housing;

a mounting plate located adjacent to said light source and including a first aperture;

a translucent lens located adjacent to said mounting plate;

an EL film located adjacent to said translucent lens with a second aperture having a first shape that is laser cut; and a lens that is located a second distance from said EL film and includes a sandblasted inner surface facing said EL film, wherein said first shape projected on said lens appears to float behind said lens and in front of said EL film when said incandescent light bulb is on.

* * * * *